US006185834B1

(12) United States Patent
Yang

(10) Patent No.: US 6,185,834 B1
(45) Date of Patent: Feb. 13, 2001

(54) CENTRIFUGALLY ROTATING TYPE CLOTHES DRYING HANGER STRUCTURE

(76) Inventor: Tai-Her Yang, No. 59, Chung Hsing 8 St., Si-Hu Town, Dzan-Hwa (TW)

( * ) Notice: Under 35 U.S.C. 154(b), the term of this patent shall be extended for 0 days.

(21) Appl. No.: 09/385,052

(22) Filed: Aug. 30, 1999

Related U.S. Application Data

(63) Continuation-in-part of application No. 09/333,912, filed on Jun. 16, 1999.

(51) Int. Cl.[7] ..... F26B 17/24

(52) U.S. Cl. ..... 34/58; 34/236; 34/621; 34/665

(58) Field of Search ..... 34/58, 59, 202, 34/204, 208, 210, 215, 216, 217, 236, 619, 621, 622, 665; 211/78, 86, 95, 119.06, 119.07, 163, 196, 197, 205; 248/316.8, 349.1, 353

(56) References Cited

U.S. PATENT DOCUMENTS

| | | | | |
|---|---|---|---|---|
| 3,424,317 | * | 1/1969 | Singer | 211/167 |
| 3,868,835 | * | 3/1975 | Todd-Reeve | 68/20 |
| 4,101,037 | * | 7/1978 | Allesch et al. | 211/167 |
| 4,682,424 | * | 7/1987 | Irving | 34/202 |
| 4,761,896 | * | 8/1988 | Miyata | 34/77 |
| 5,280,841 | * | 1/1994 | Van Deursen | 211/197 |
| 5,458,249 | * | 10/1995 | Shang-Lu | 211/197 |
| 5,713,137 | * | 2/1998 | Fujita | 34/106 |

* cited by examiner

*Primary Examiner*—Pamela Wilson
(74) *Attorney, Agent, or Firm*—Bacon & Thomas, PLLC

(57) ABSTRACT

A centrifugally rotating clothes hanger includes a motor for rotating the hanger, the centrifugal force resulting from rotation of the hanger being used to swing water off the clothes and assist in drying the clothes due to the wind-drying effect caused by rotation-induced airflow.

24 Claims, 17 Drawing Sheets

CENTRIFUGALLY ROTATING TYPE CLOTHES DRYING HANGER STRUCTURE

This application is a C-I-P of Ser. No. 09/333,912 filed Jun. 16, 1999.

BACKGROUND OF THE INVENTION

1. Field of the Invention

The centrifugally rotating type dress drying hanger structure of the invention is a clothes hanger that includes a motor for rotating the hanger. The motor causes the hanger to make unidirectional or to make bi-directional periodic positive-negative rotations. The rotational centrifugal force is particularly utilized to swing water off the clothes due to the wind-drying effect caused by the air flow and centrifugal force.

2. Description of the Prior Art

Washed and spun-dry clothes are usually hung for sun-drying or wind-drying or dried by an electric clothes dryer. The natural wind or sun drying takes a longer time and is more troublesome if the weather condition varies, and the electric type clothes dryer is also disadvantageous due to its large power consumption, the tendency to more easily harm the clothes, and difficulty in removing water in highly humid air.

SUMMARY OF THE INVENTION

The main purpose of the invention is to provide a centrifugally rotating type clothes drying hanger structure. The circular edge of the motor driven rotor is installed with hanging holes, slots, hooks, elastic clamps, rings, support frames, or other mechanisms to allow for directly hanging clothes or indirectly coupling with clothes frames for holding clothes, and which are arranged to swing the directly held or hanging clothes, or the indirectly hanging clothes frames for a wind-drying effect. As a result, the drying hanger structure of the invention can substitute for the unpredictable natural wind-drying or the traditional electric heated air drying to wind-dry the clothes, saving not only electric power but also leaving the clothes unharmed.

The further design of the invention is that a ring shape or cone shape water-proof cover can be installed on the motor stator, motor hanging device, or fixing body for installing the hanging device, or the water-proof cover can be a self-standing structure installed integrally with the driving motor, rotational output device, motor control device, etc., the water-proof cover preventing water spattering when rotating the clothes or providing a water collecting function, and the water-proof cover can be further provided with vent holes or installed with an operable window type cover to provide a venting effect for the water-proof cover and to allow for convenient clothes intake and removal.

A still further design of the invention is that an auxiliary electric heater device or an ultraviolet lamp can be installed to simulate the sun sterilization effect, to thereby let the clothes obtain the double effect of wind-drying and warm drying simultaneously.

DETAILED DESCRIPTION OF THE PREFERRED EMBODIMENTS

Figure 1:
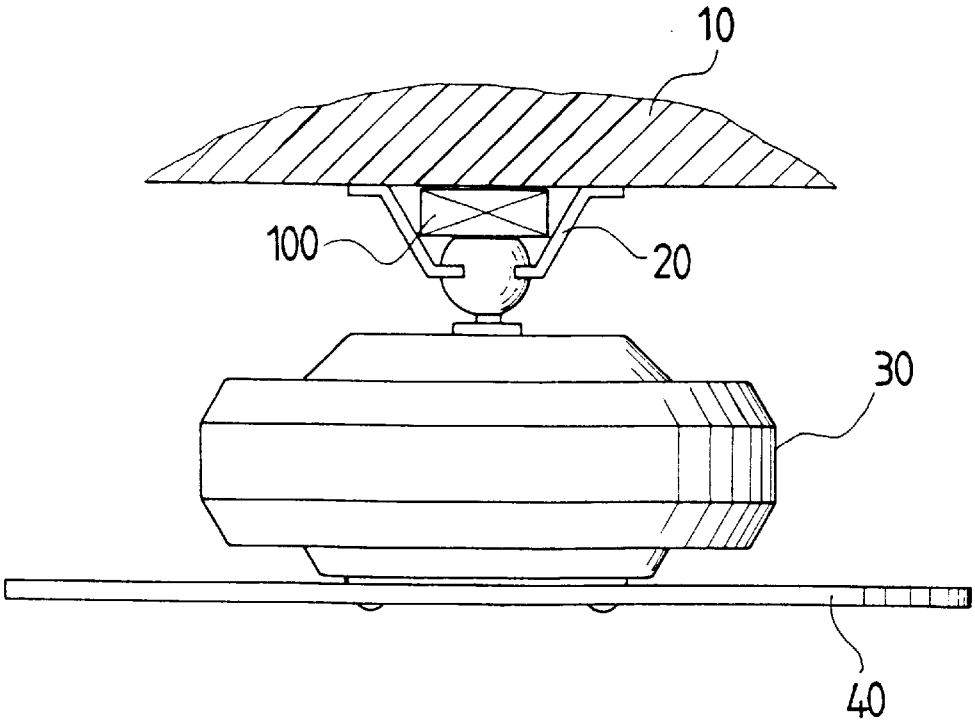
FIG. 1 is an elevated view of the invention.
Figure 2:
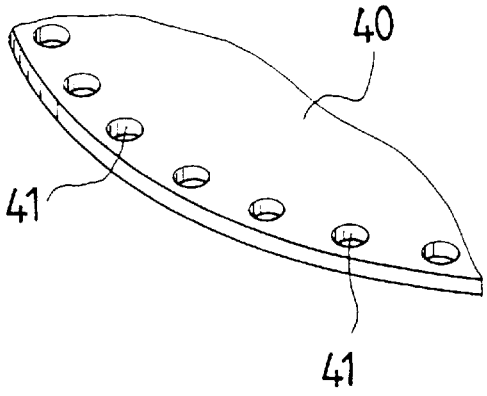
FIG. 2 is a 3-D isometric drawing of the invention illustrating the rotational output device.
Figure 3:
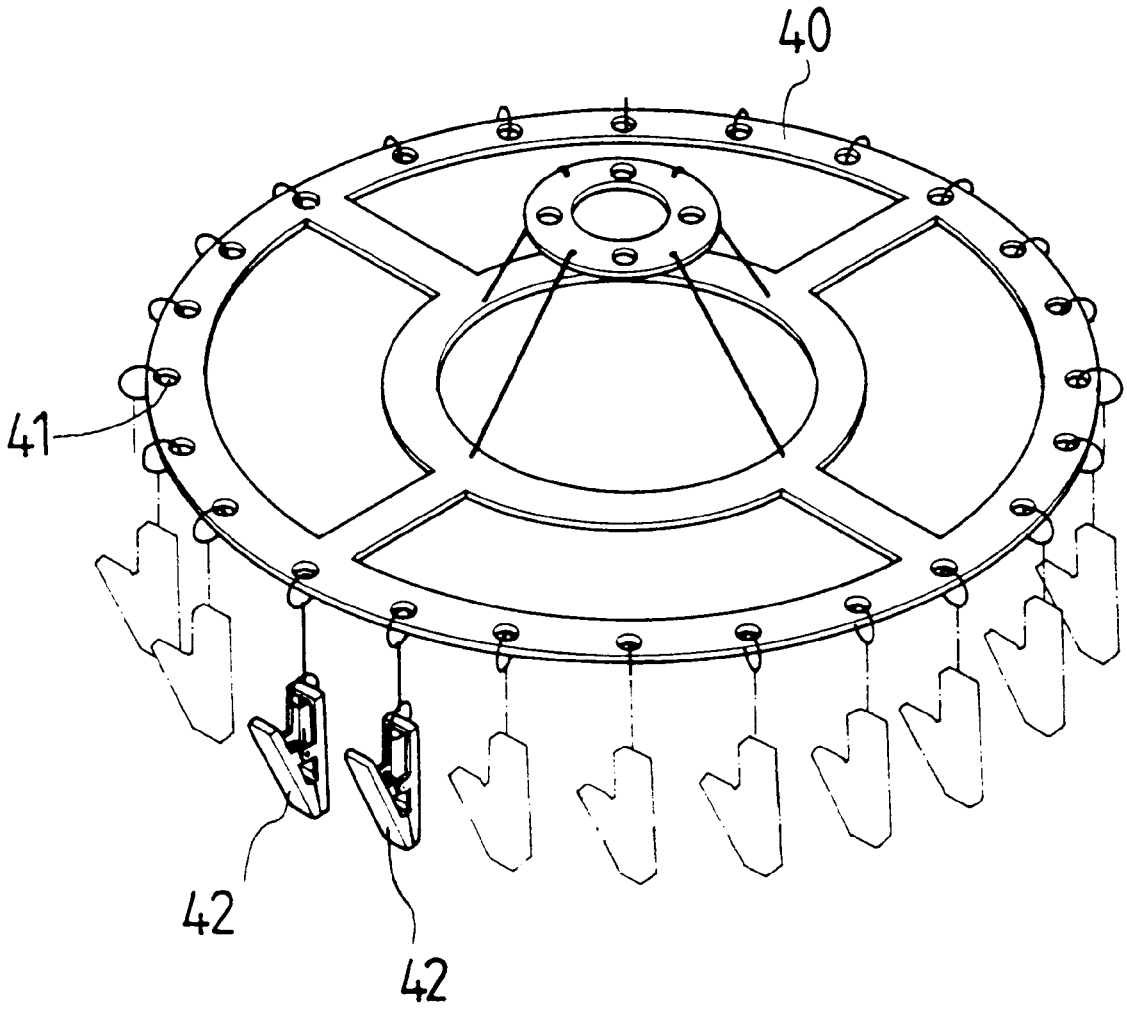
FIG. 3 is a 3-D isometric drawing of the invention illustrating an embodiment in which the rotational output device is installed with elastic clamps.
Figure 4:
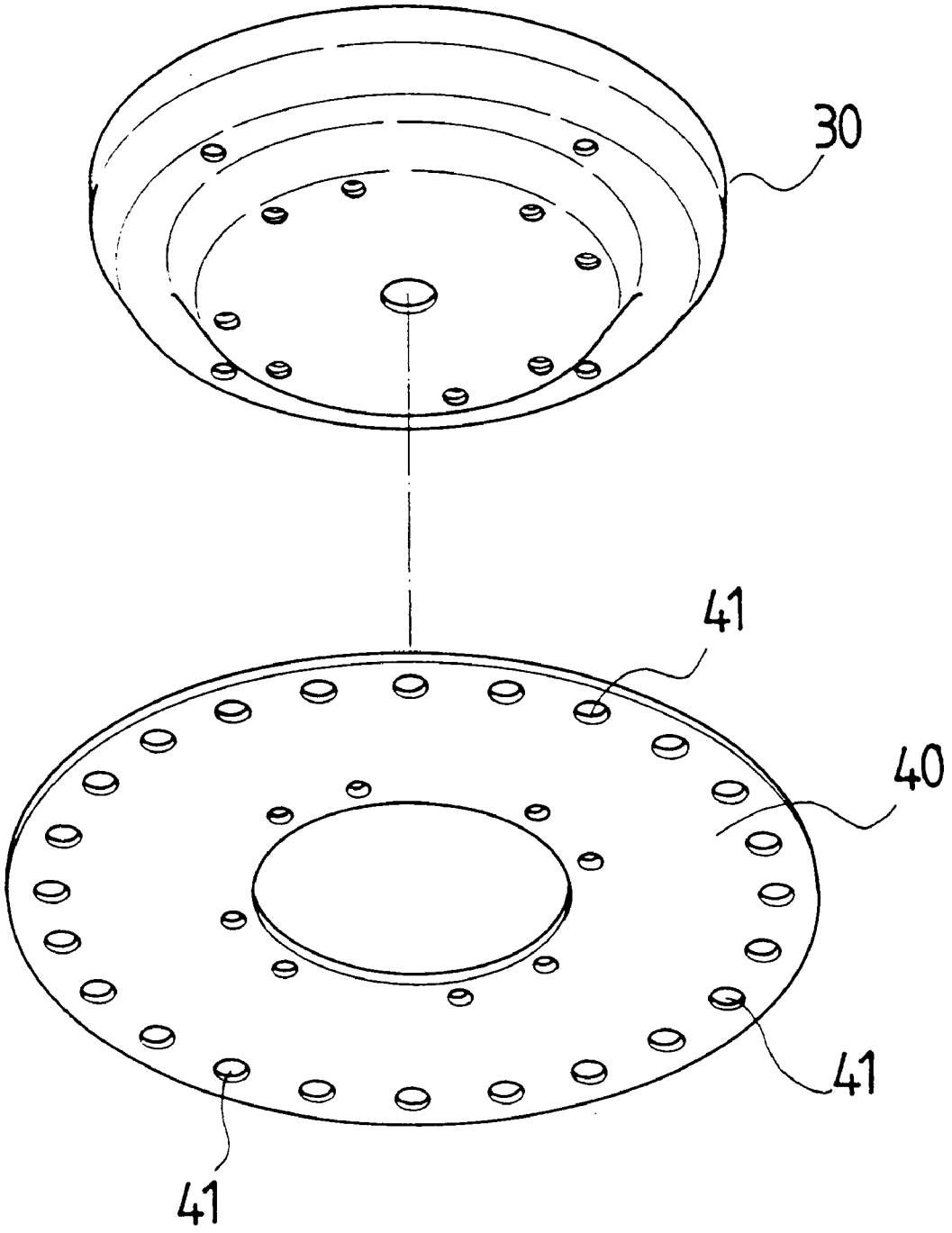
FIG. 4 is an exploded 3-D isometric drawing of the invention illustrating the driving motor and the rotational output device.

FIG. 1 is a basic schematic diagram of the invention illustrating the basic structural principles of a centrifugally rotating type clothes drying hanger structure, in which the circular edge of the motor driven rotor is installed with hanging holes, slots, hooks, elastic clamps, rings, support frames, or other mechanisms to allow for directly hanging clothes or for indirectly coupling with clothes frames arranged to hold clothes, in order to swing the directly held or hanging clothes, or the indirectly hanging clothes frames, to achieve a wind-drying effect. The clothes hanging dryer structure of this embodiment includes the following elements:

A driving motor 30 of the internal rotor type or external rotor type and constituted by AC, DC, or combined AC and DC motors to provide a rotational output directly or through reducing devices such as gears, friction wheels, or belts and pulleys;

One or more than one rotational output device 40, either directly constituted by the motor rotor or constituted by a rotational output device driven by the motor rotor after speed reduction (as shown in FIGS. 2 to 4), and installed with hanger holes 41, slots, hanging hooks, elastic clamps 42, rings, or support frames, etc. to directly hang the clothes or indirectly hang clothes frames;

A motor control device 100 installed on the motor body or the hanger structure, or separately installed, and constituted by a manual control device or remote control device, the control device 100 being installed between the power source and the driving motor to control the motor in one or more than one of the following functions: On/Off, positive/negative rotation, periodic positive-negative rotation and length of period, rotating speed setting, driving motor operation time setting, etc.; whereof since the technical background of this control device is the same as the one used in the market product of a ceiling fan, it is not repeated herein;

A support structure including a hanger fixing body 10 such as a ceiling, wall, beam, column, support frame, etc., or other fixing body which can be hung four coupling with the motor hanging device 20 to provide hanging of the driving motor; or an integrated casing structure for installing the aforesaid driving motor 30, the output device 40, and the motor control device 100, etc. wherein the casing is provided with support points or base frames to appear as an integral self-standing structure.

Figure 5:
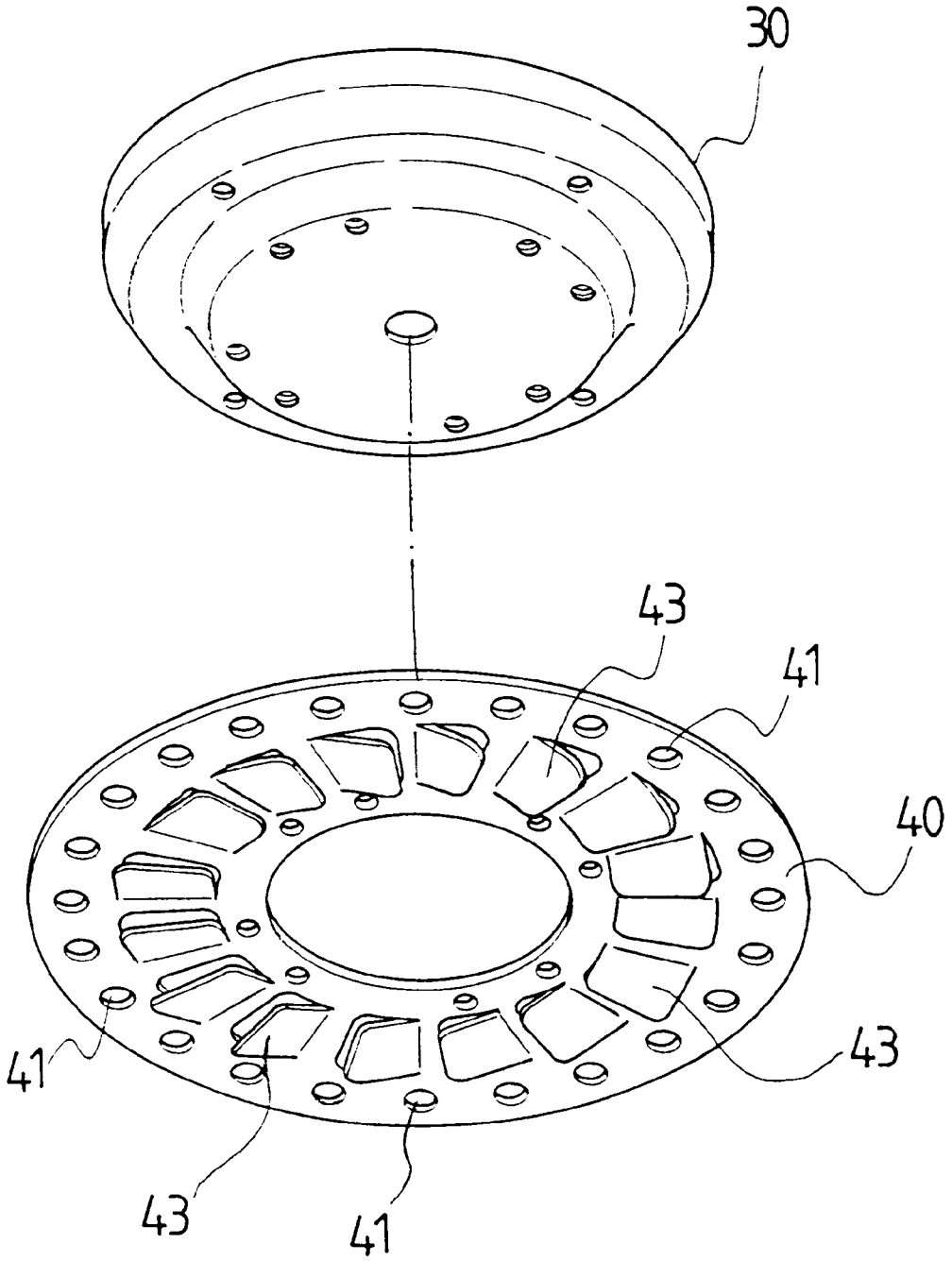
FIG. 5 is an exploded 3-D isometric drawing of the invention illustrating an embodiment in which the rotational output device is installed with blades.

As shown in FIG. 5, the surface of the aforesaid rotational output device 40 can be further punched to install plural numbers of blade structures 43 (or otherwise further installed with auxiliary blades) to produce auxiliary air flow during rotation, to thereby strengthen the wind-drying effect and remove moisture.

Figure 6:
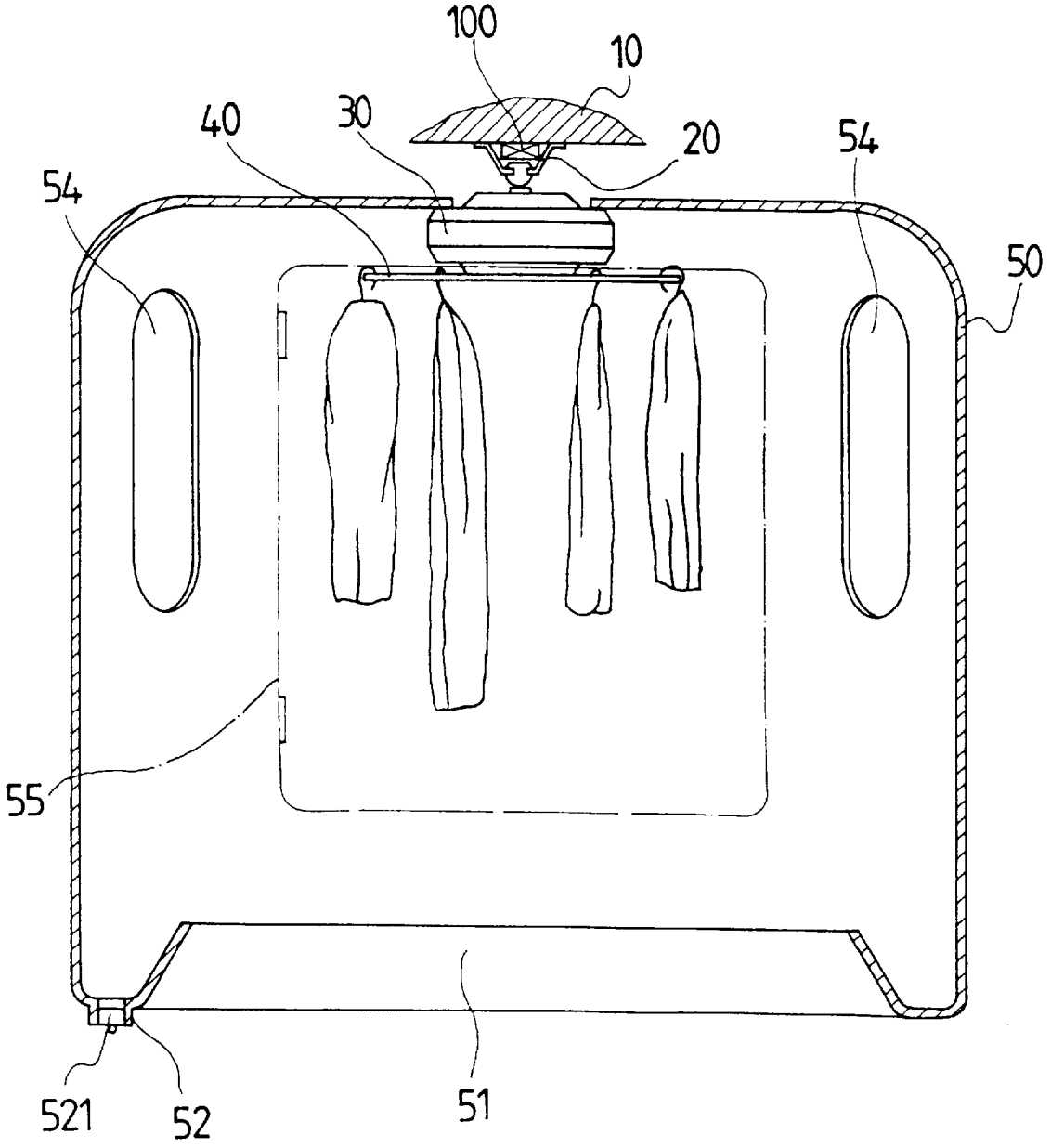
FIG. 6 is an elevated view illustrating an embodiment in which the invention is further installed with a water-proof cover.
Figure 7:
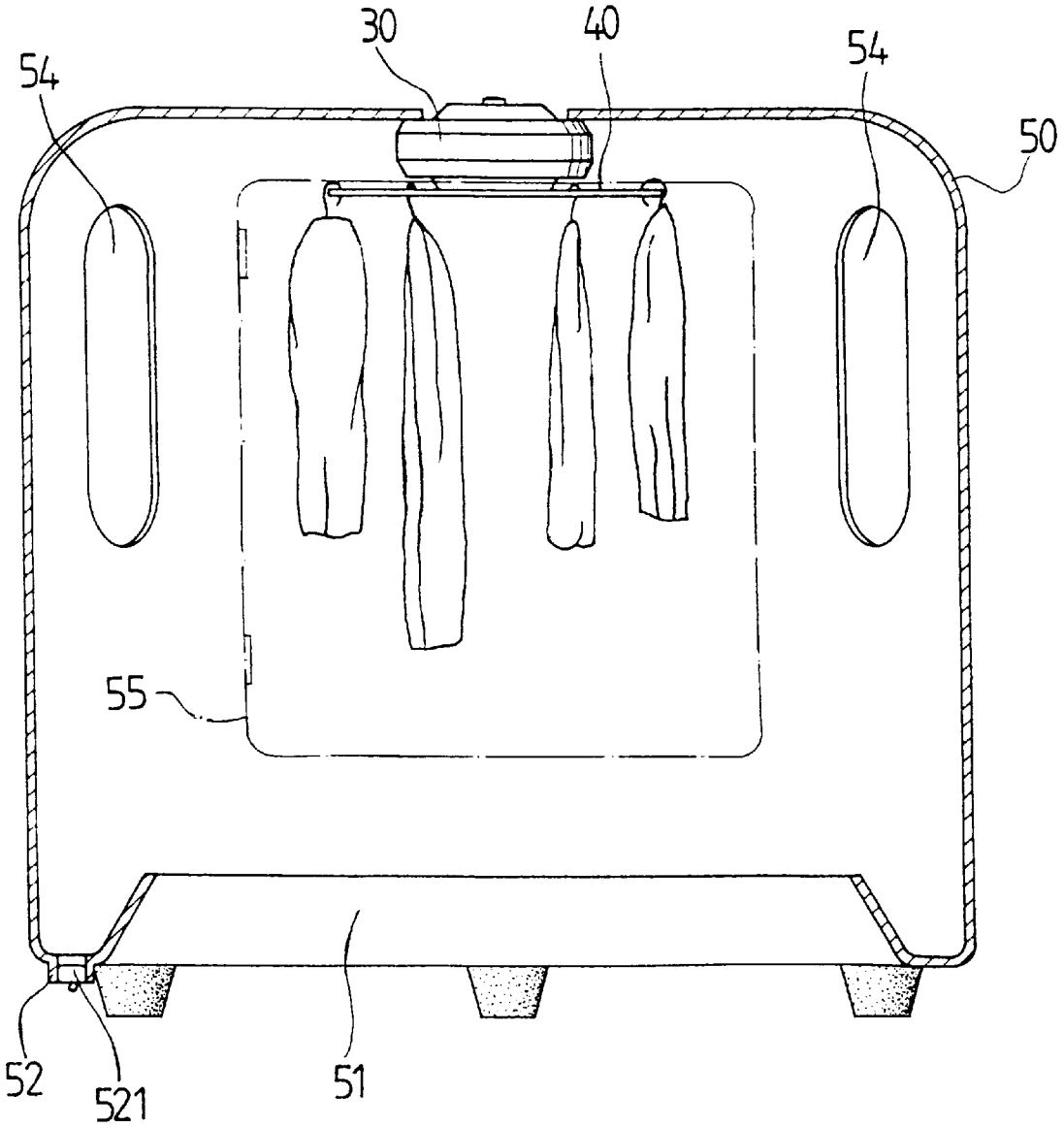
FIG. 7 is an elevated view illustrating an embodiment in which the invention is further installed with a self-standing type ring shape water-proof cover.
Figure 8:
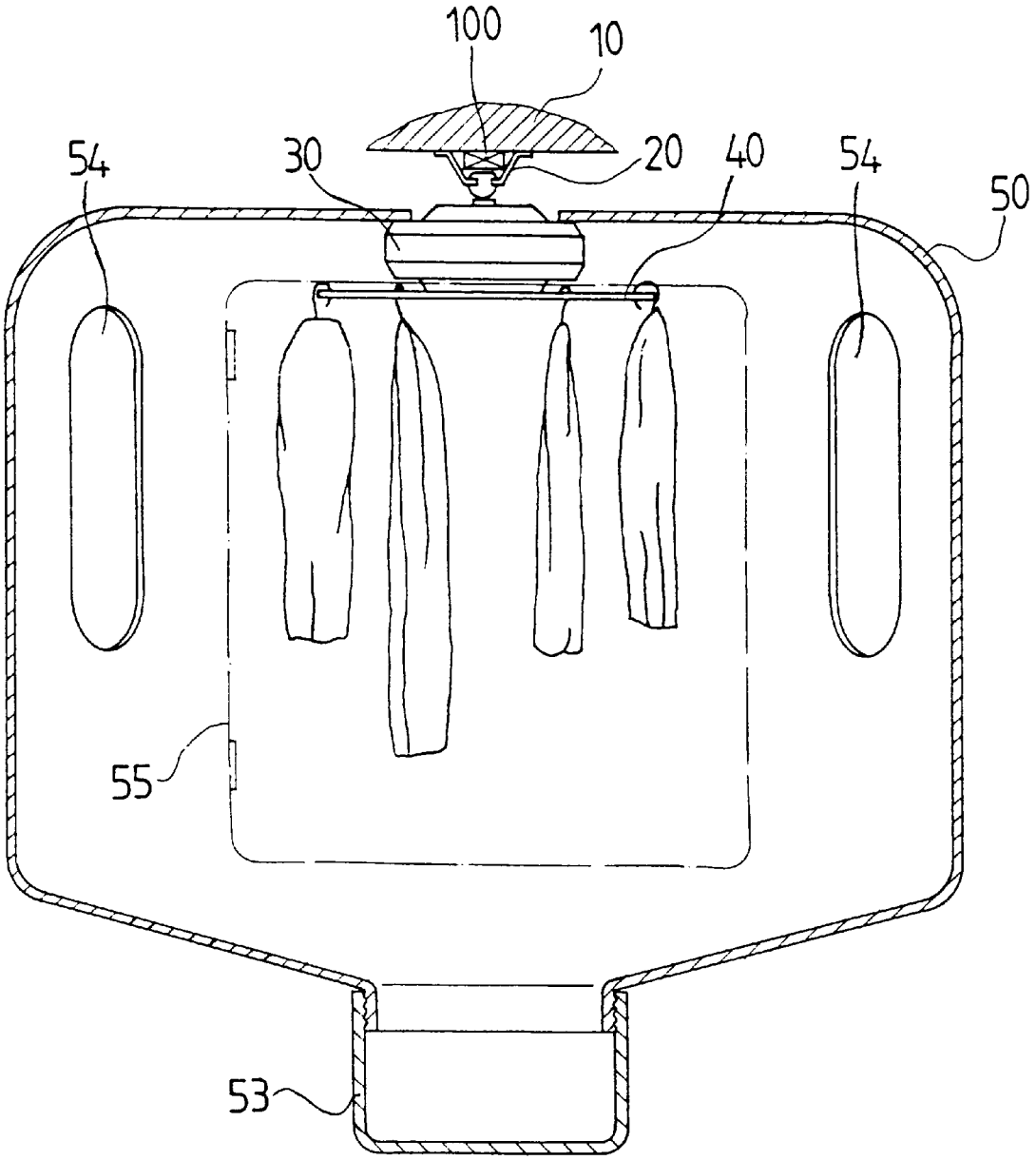
FIG. 8 is an elevated view illustrating an embodiment in which the invention is further installed with another kind of ring shape water-proof cover.
Figure 9:
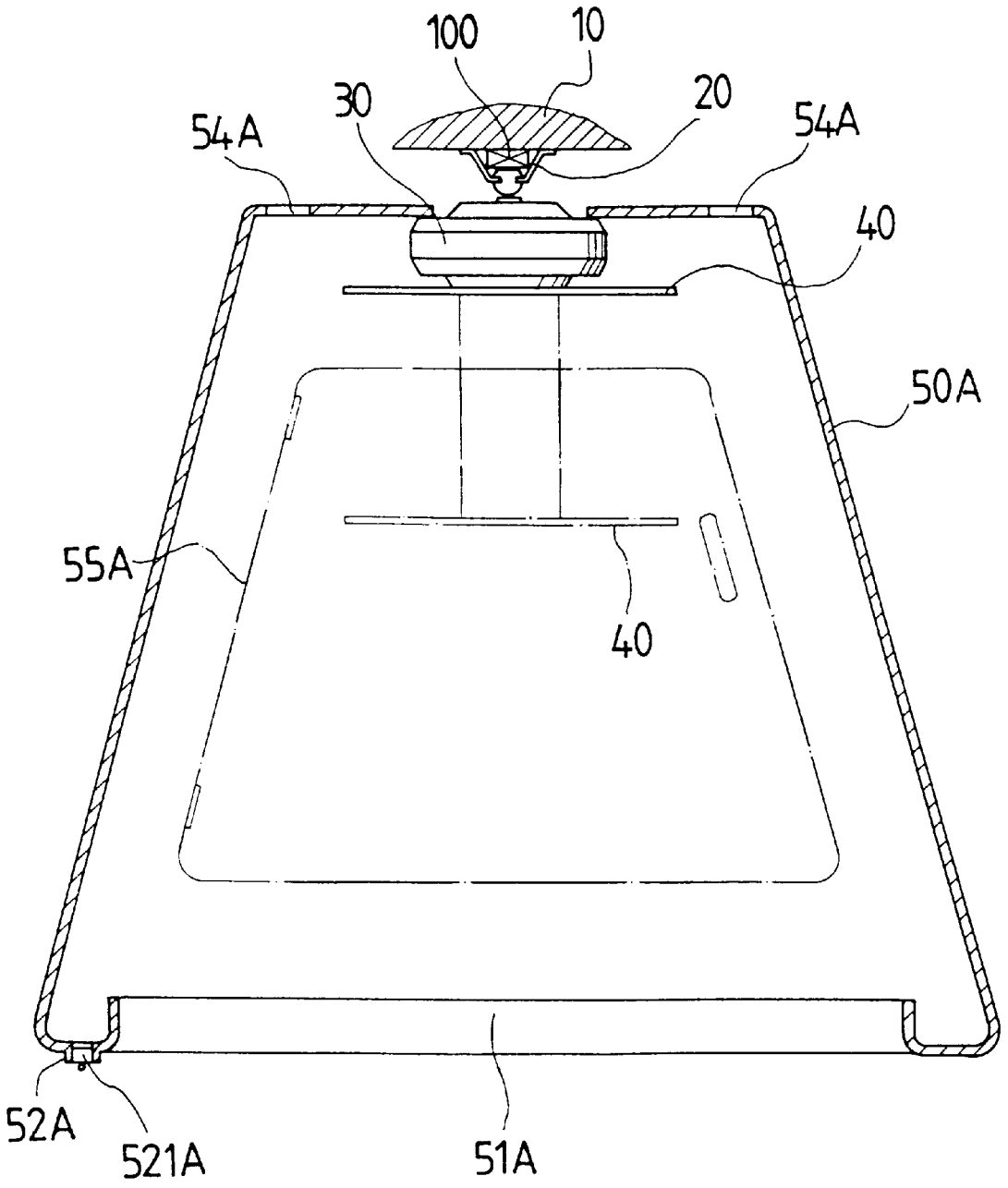
FIG. 9 is an elevated view illustrating an embodiment in which the invention is further installed with a cone shape water-proof cover.
Figure 10:
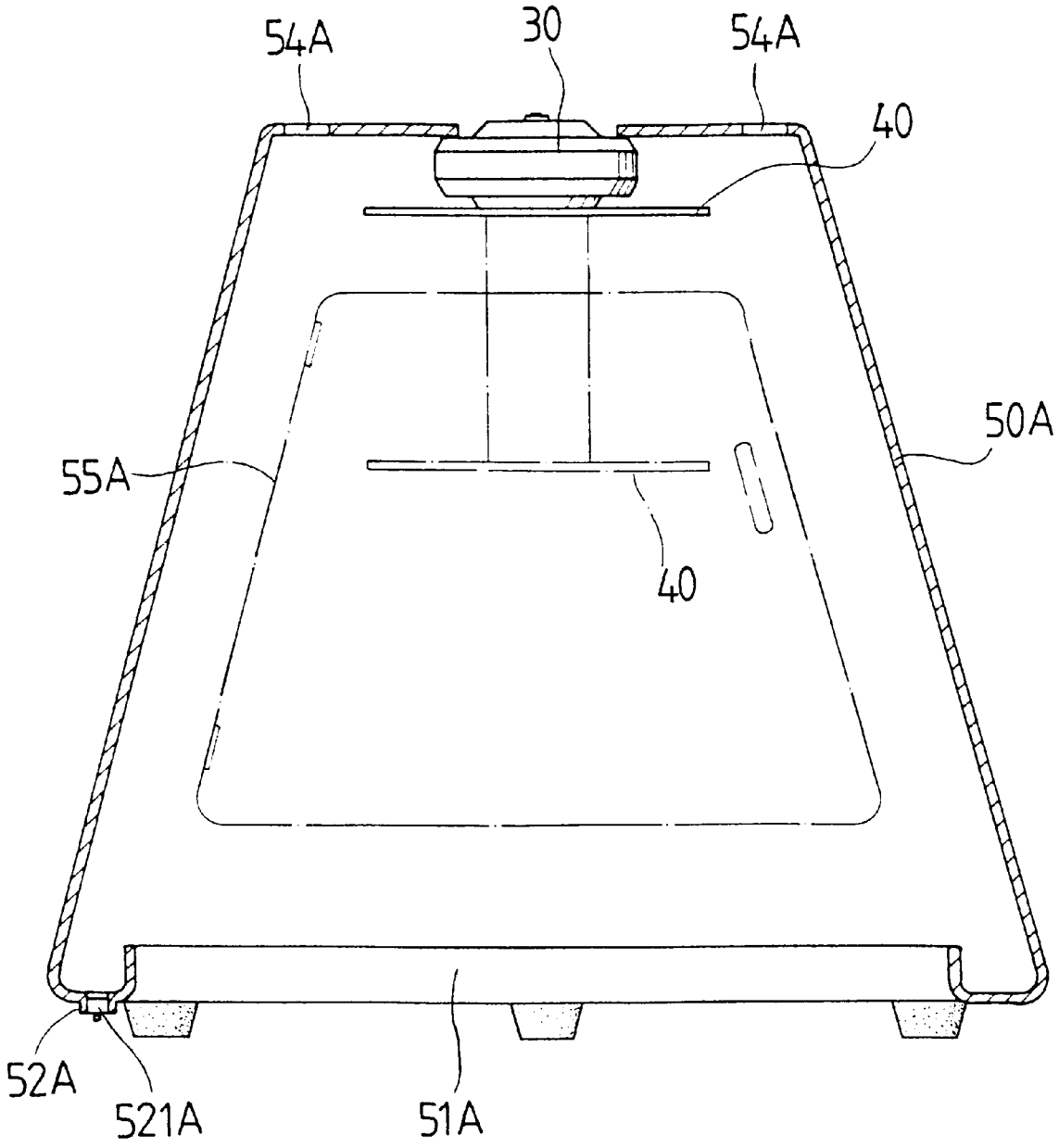
FIG. 10 is an elevated view illustrating an embodiment in which the invention is further installed with a self-standing type cone shape water-proof cover.

The aforesaid centrifugally rotating type clothes drying hanger structure can be further installed with a water-proof cover 50, with FIGS. 6 through 8 respectively illustrating the embodiment of a ring shape water-proof cover 50, although those skilled in the art will appreciate that the actual shape of the water-proof cover 50 need not actually be fixed and can also take the form of the cone shape water-proof cover 50A shown in FIGS. 9 and 10 so long as water spattering during rotation of the clothes is prevented through the water-proof cover 50 or 50A. Further, the design of the said water-proof cover 50 need not be limited to hanging structures but can similarly also be designed to include self-standing types (as shown in FIGS. 7 and 10), all such variations being intended to be included within the scope of the invention.

The water-proof cover 50 or 50A can be further installed at its lower part with inward or outward bent ring shape banks 51 or 51 A, drain holes 52 or 52A, and drain plugs 521 or 521A, or it can be installed in a drain faucet to thereby provide water collection and draining functions in case of water spattering at initial clothes wetting. The water collecting functioning structure can be further installed at the lower part of the cone shape water-proof cover with a collector cup 53 or a water outlet for placing water collector devices such as buckets. Further, the water-proof cover 50 or 50A can be further installed with a vent port 54 or 54A or an operable window type cover 55 or 55A to provide the water-proof cover 50 or 50A with a venting effect, and the window type cover 55 or 55A can be opened for easy clothes intake and removal.

Figure 11:
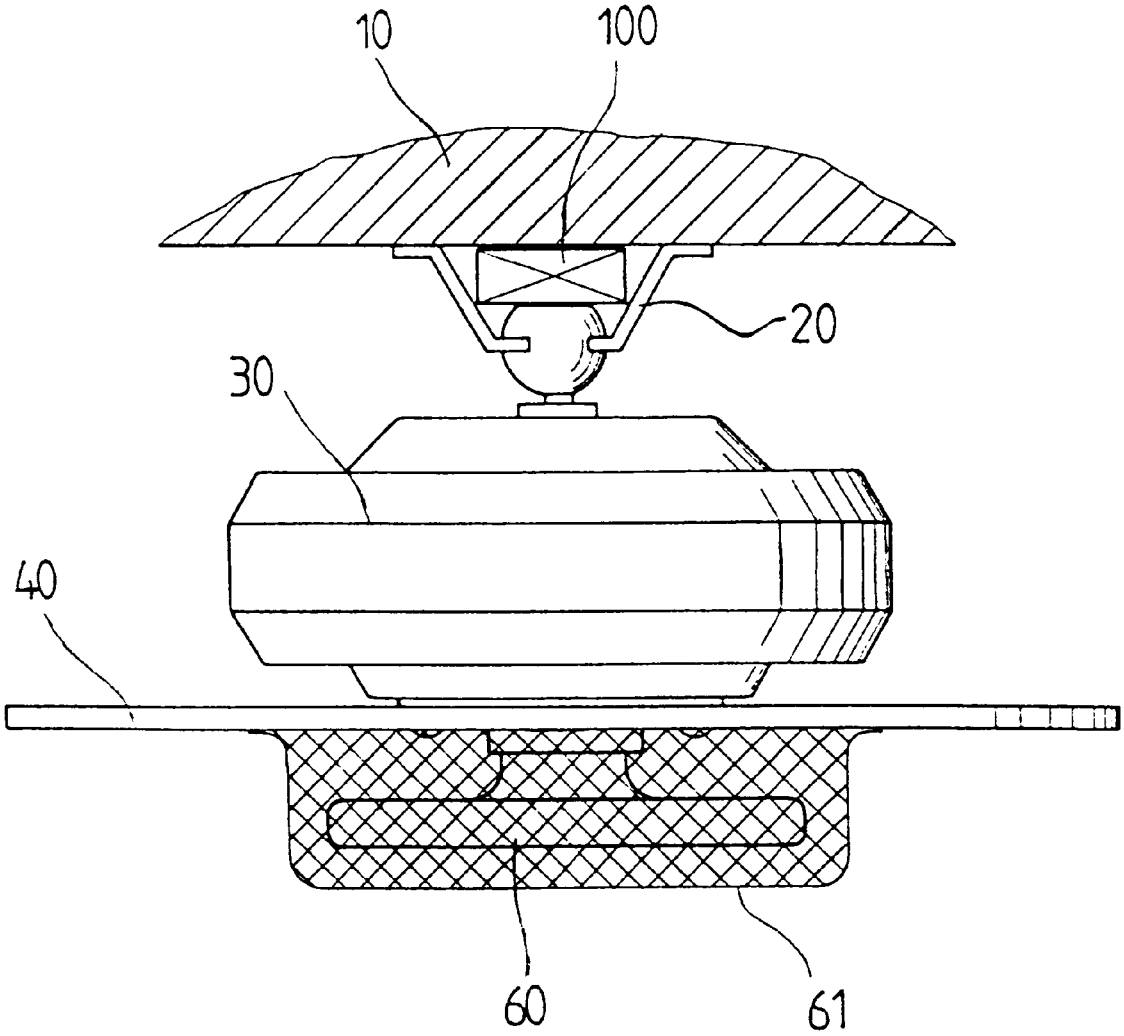
FIG. 11 is an elevated view illustrating an embodiment in which the invention is further installed with an auxiliary electric heater device.
Figure 12:
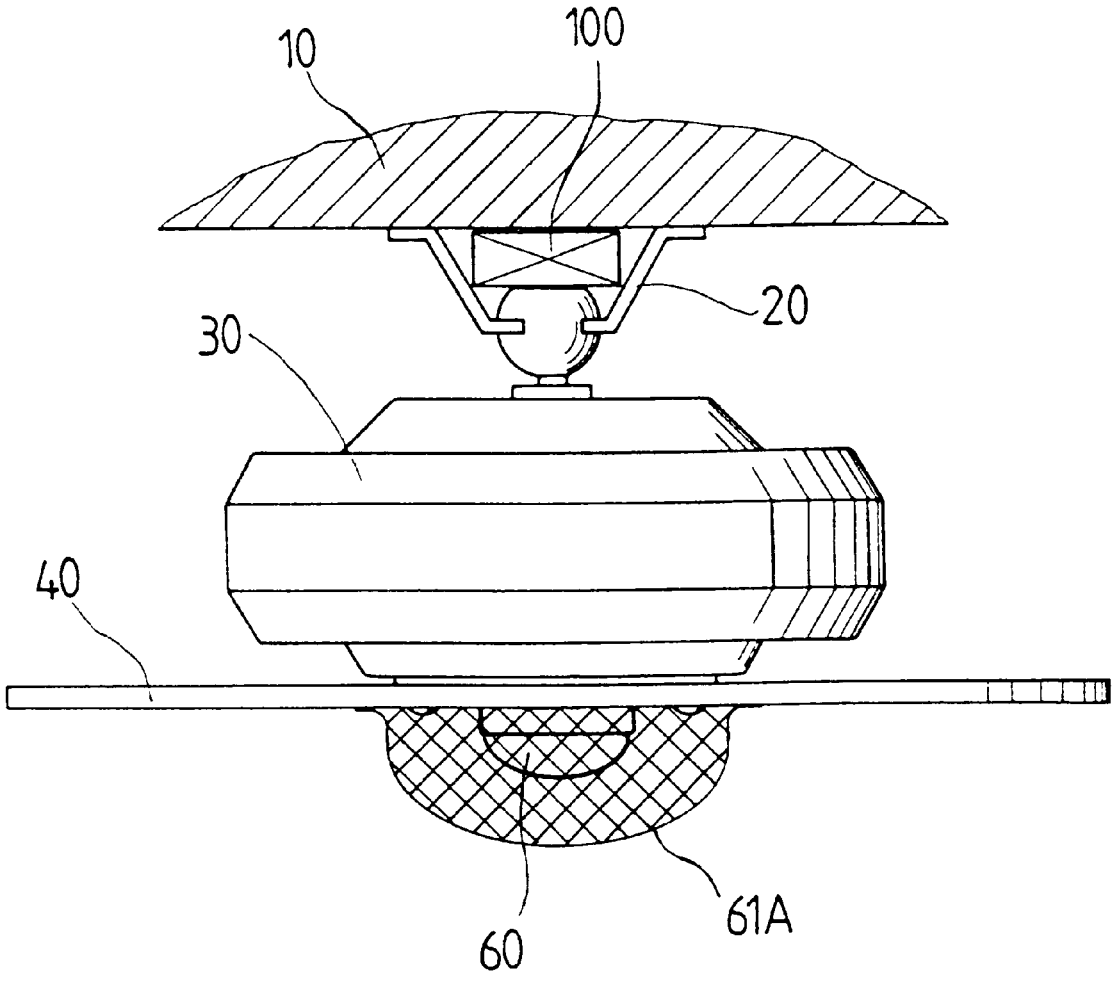
FIG. 12 is an elevated view illustrating an embodiment in which the invention is further installed with an ultraviolet lamp.

In addition, an auxiliary electric heater device 60 can be installed at one end or any randomly selected location of the output device of the invention as shown in FIGS. 11 and 12. The electric heater device 60 can be an electric power heater (as shown in FIG. 11) or an additionally installed ultraviolet lamp to simulate the sunshine sterilization effect (as shown in FIG. 12), and its outer edge may be covered by a protection cover 61 or 61A for producing a slight amount of warm air during clothes rotation to assist the double wind-drying effect.

Figure 13:
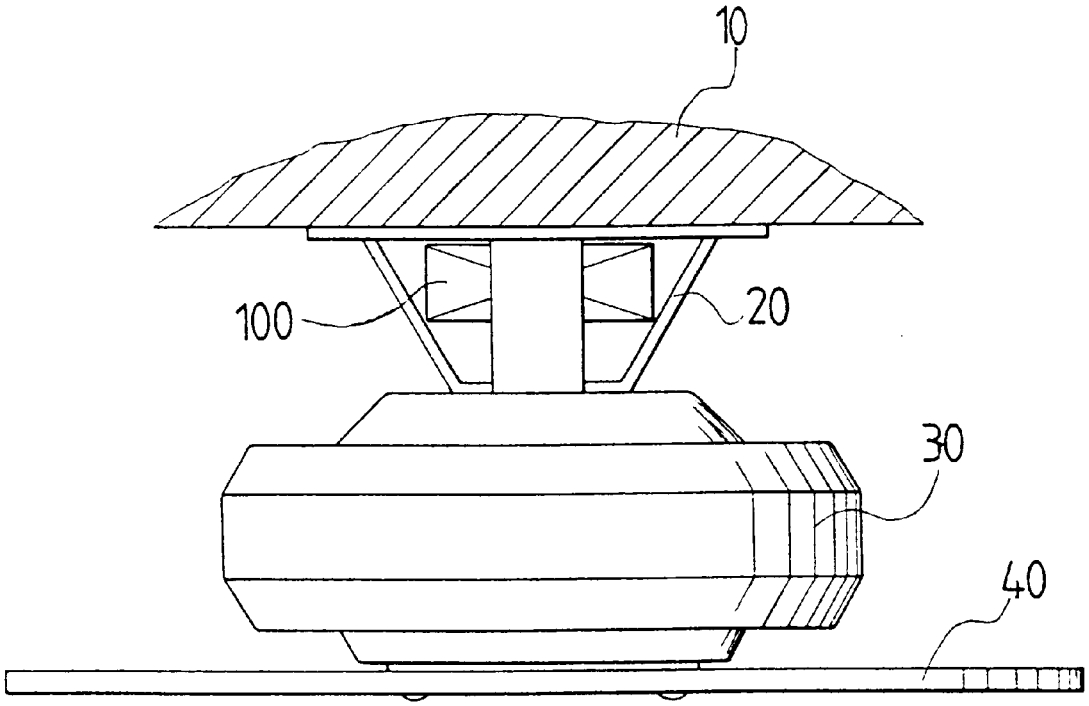
FIG. 13 is an elevated view illustrating an embodiment in which the driving motor is directly installed on the motor hanging device.
Figure 14:
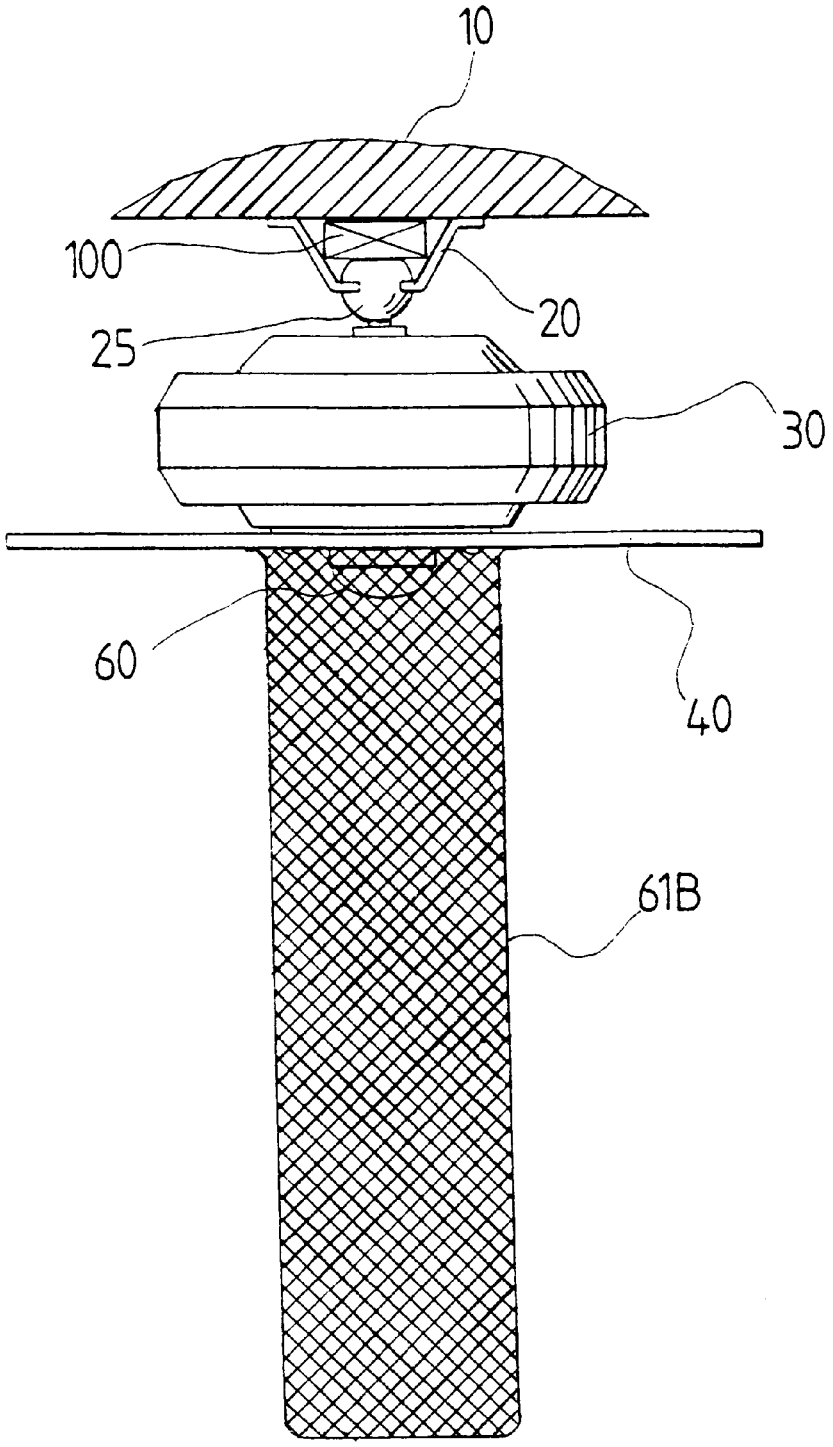
FIG. 14 is an elevated view illustrating an embodiment having an extended cylindrical shape protective cover.

In addition, in further examples of the preferred embodiments, a removable hanger ball 25 can be installed between the motor hanging device 20 and the driving motor 30, or the driving motor 30 can also be directly combined with the motor hanging device 20 (as shown in FIG. 13), wherein the driving motor 30 can directly drive the output device 40 for rotational driving, to thereby swing moisture off the hanged clothes through centrifugal force thus to obtain a wind-drying effect. Further, as shown in FIG. 14, the shape of the protective cover 61B of the invention located under the center of the output device 40 can also be properly extended to appear as a cylindrical separator, and the separator can also be provided with radial type separator fins in the axial direction, to thereby let the ring shape-distributed hanged clothes obtain adequate separation during rotation and prevent the clothes from twisting together, thus ensuring that the clothes will not interfere with one another.

Figure 15:
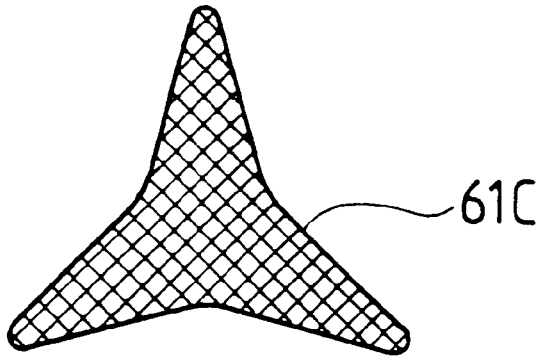
FIG. 15 is an elevated view illustrating an embodiment having a triangular column shape protective cover.
Figure 16:
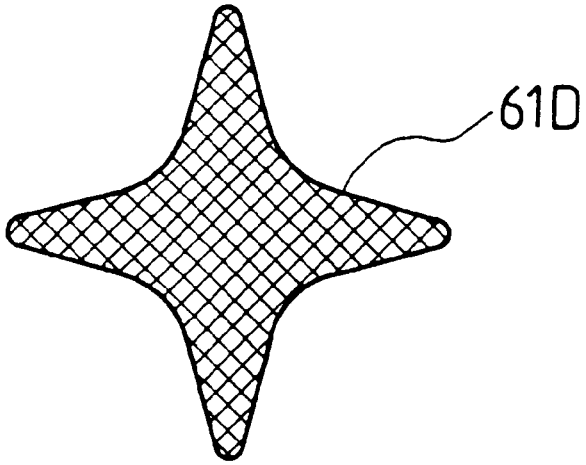
FIG. 16 is an elevated view illustrating the quadruple column shape protective cover.

Still further, as shown in FIGS. 15 and 16, the said protective covers 61C and 61D can be designed to have the separator fins in a triangular column or quadruple columns or other shapes that provide a separator for hanged clothes, ensuring that the clothes will not be twisted with each other.

Figure 18:
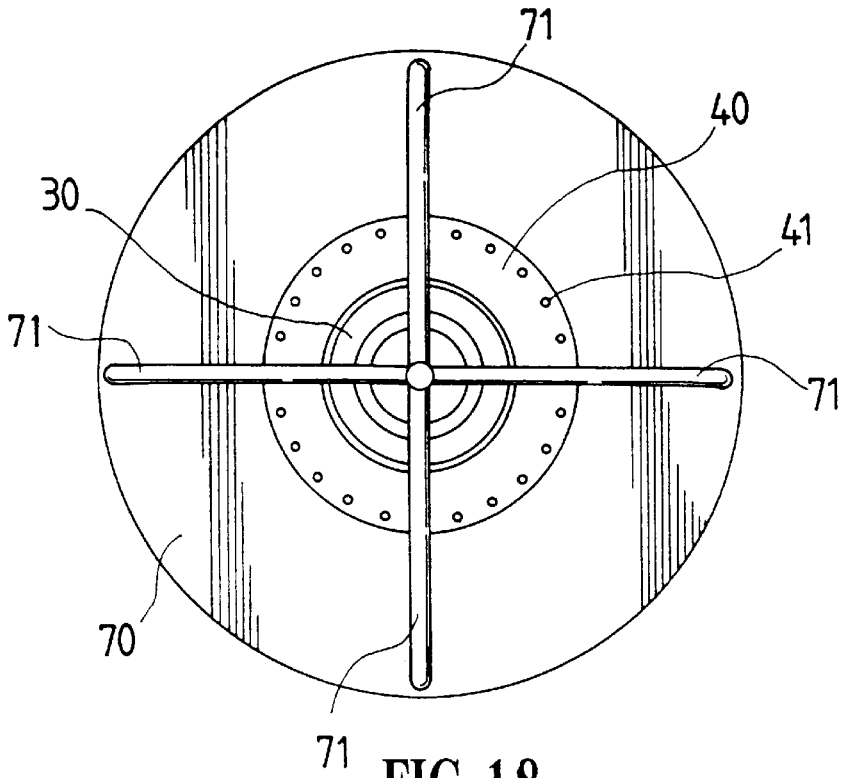
FIG. 18 is a top view of a variation of the embodiment of FIG. 17 in which the standalone type casing is constituted by a bottom frame and four support bars.
Figure 17:
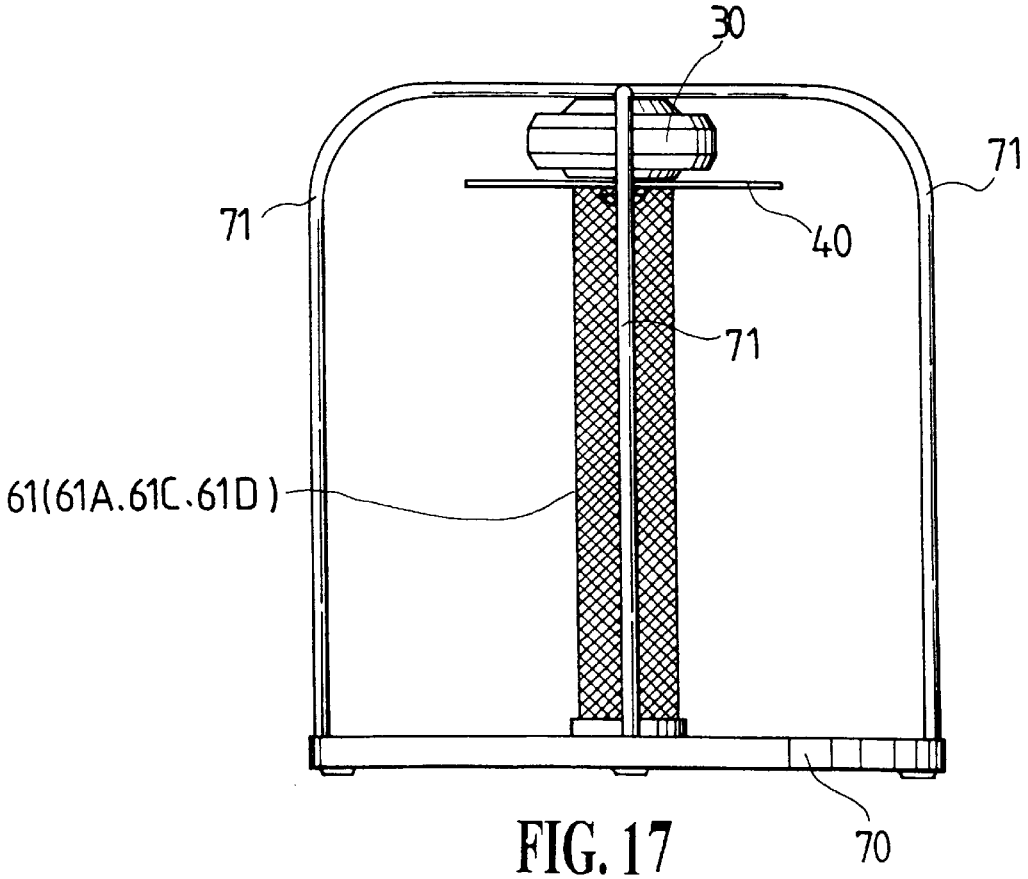
FIG. 17 is a side view of an embodiment of the invention having a standalone type casing constituted by a bottom frame and support bars.
Figure 19:
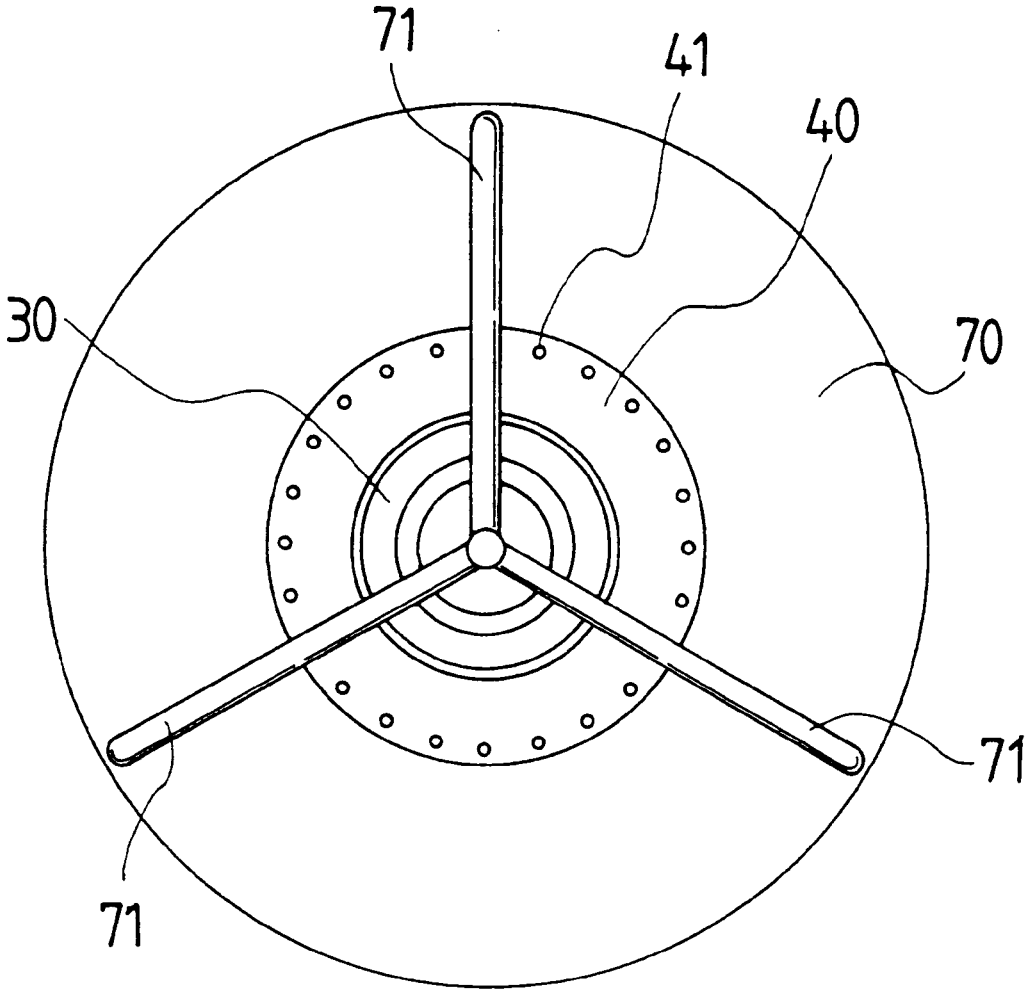
FIG. 19 is a top view of a variation of the embodiment of FIG. 17 in which the standalone type casing is constituted by a bottom frame and three support bars.

Finally, the casing can be constituted by the bottom frame 70 and the support bars 71 as the aforesaid supporting structure for attachment to the driving motor 30 and the rotational output device 40 to appear as an integrated standalone combination structure, wherein the number of said support bars or tubular structure 71 is at least three (as shown in FIG. 19), four (as shown in FIGS. 17 and 18), or more.

Figure 20:
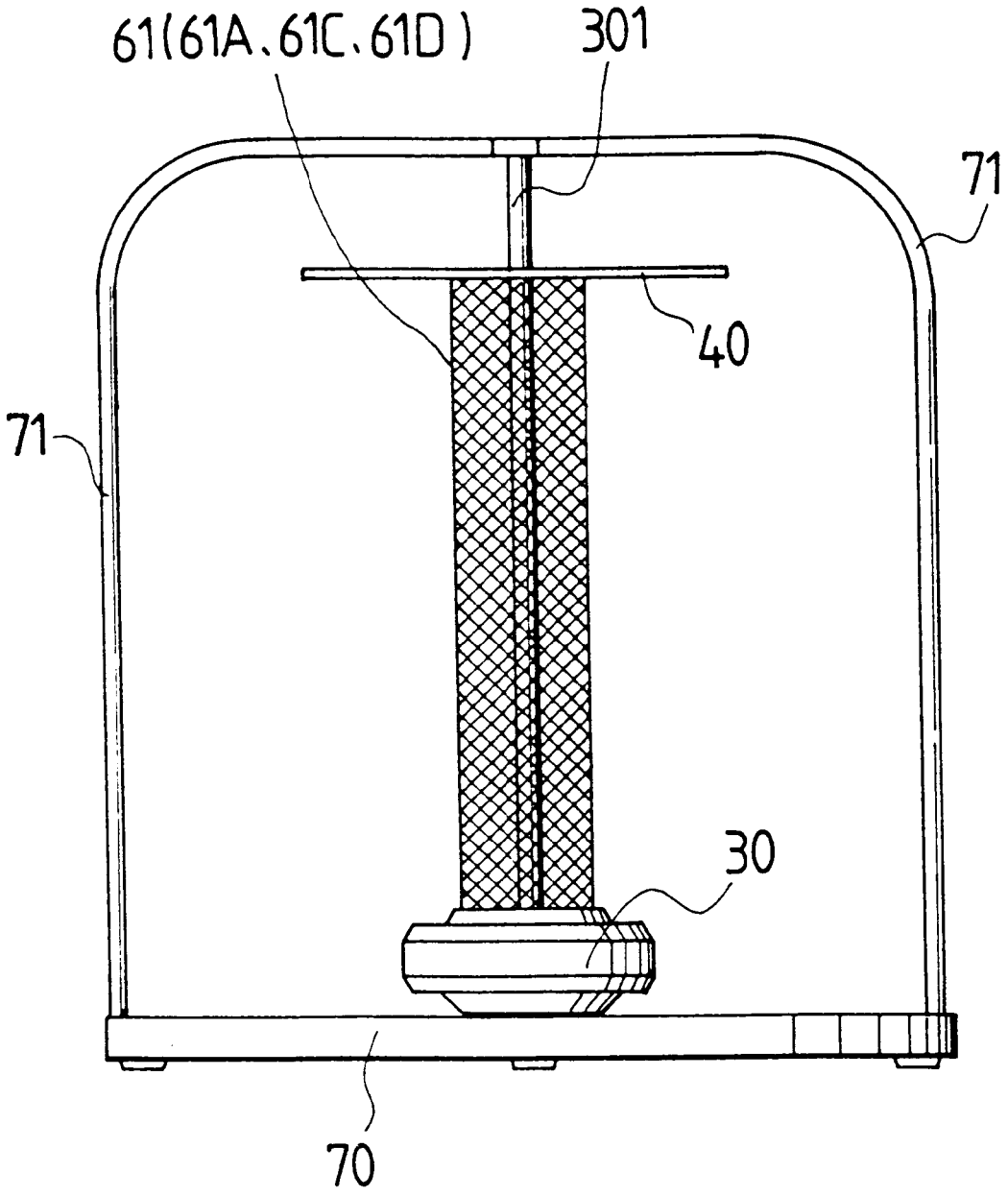
FIG. 20 is a side view of an upside down combined motor according to an alternative preferred embodiment of the invention.

Based on the same design spirit of the invention, if necessary the driving motor 30 can be upside down combined as shown in FIG. 20, so that the said motor 30 can be installed at the bottom of the casing frame 70 and the motor transmission rod 301 can be adequately extended to install the output device 40, while the protective covers 61, 61A, 61C or 61D are still installed between the output device 40 and the driving motor 30 for separation.

As summarized from the above description, the centrifugally rotating type clothes drying hanger structure design is based on a clothes wind-drying principle through motor rotation to swing the clothes for achieving a natural wind-drying effect while substituting for unpredictable natural wind as well as the expensive and high power consuming electric warm air dryer, thereby to save power consumption without harming the clothes, and therefore this invention is innovative and is practically useful with definite functions.

What is claimed is:

1. A centrifugally rotating clothes drying hanger, comprising:

a driving motor;

at least one rotational output device connected to said driving motor;

a motor control device connected between a power source and said motor for causing said motor to rotate said rotational output device; and a motor support for supporting said motor while said at least one rotational output device is rotated, wherein said at least one rotational output device includes structures arranged to hang clothes so that the clothes are swung around in response to rotation of the at least one rotational output device as it is driven by the motor, whereby swinging of said clothes causes a wind-drying effect to facilitate drying of said clothes.

2. A centrifugally rotating clothes drying hanger as claimed in claim 1, wherein said structures arranged to hang clothes include structures selected from the group consisting of hooks, clamps, holes, slots, and rings.

3. A centrifugally rotating clothes drying hanger as claimed in claim 2, wherein said structures selected from the group consisting of hooks, clamps, holes, slots, and rings are arranged to directly hang said clothes.

4. A centrifugally rotating clothes drying hanger as claimed in claim 1, wherein said structures selected from the group consisting of hooks, clamps, holes, slots, and rings are arranged to indirectly hang said clothes by support clothes hangers on which said clothes are hung.

5. A centrifugally rotating clothes drying hanger as claimed in claim 1, wherein said motor controller is arranged to control functions selected from the group consisting of: motor on/off, forward and reverse rotation of the motor, periodic forward and reverse rotation of the motor, length of rotation period, rotation speed setting, and driving motor operation time setting.

6. A centrifugally rotating clothes drying hanger as claimed in claim 1, wherein said motor support is arranged to suspend said driving motor from a support structure.

7. A centrifugally rotating clothes drying hanger as claimed in claim 1, wherein said motor support is an integrated casing structure arranged to support said motor, said at least one rotational output device, and said motor control device.

8. A centrifugally rotating clothes drying hanger as claimed in claim 1, wherein said motor support includes support points to provide a free standing structure.

9. A centrifugally rotating clothes drying hanger as claimed in claim 1, further comprising a water proof cover arranged to prevent water splattering when rotating said clothes.

10. A centrifugally rotating clothes drying hanger as claimed in claim 9, wherein said water proof cover is installed on the motor support.

11. A centrifugally rotating clothes drying hanger as claimed in claim 9, wherein said water proof cover includes a lower rim including a plurality of drain holes arranged to provide draining functions in case of water splattering.

12. A centrifugally rotating clothes drying hanger as claimed in claim 9, further comprising a water collection device in communication with said drain holes.

13. A centrifugally rotating clothes drying hanger as claimed in claim 9, wherein said water proof cover has a shape selected from the group consisting of a ring shape and a conical shape.

14. A centrifugally rotating clothes drying hanger as claimed in claim 9, wherein said water proof cover includes a plurality of vent holes.

15. A centrifugally rotating clothes drying hanger as claimed in claim 9, wherein said water proof cover includes at least one opening arranged to facilitate clothes hanging and removal.

16. A centrifugally rotating clothes drying hanger as claimed in claim 1, wherein a surface of said at least one rotational output device has extending therefrom a plurality of blades arranged to produce an auxiliary wind force during rotation.

17. A centrifugally rotating clothes drying hanger as claimed in claim 1, further comprising an auxiliary electric heating device installed on the at least one rotational output device.

18. A centrifugally rotating clothes drying hanger as claimed in claim 1, further comprising a protective cover surrounding a portion of said auxiliary electric heating device.

19. A centrifugally rotating clothes drying hanger as claimed in claim 1, wherein further comprising an ultraviolet lamp installed on said at least one rotational output device and arranged to provide a sunshine sterilization effect.

20. A centrifugally rotating clothes drying hanger as claimed in claim 1, further comprising a removable hanger ball installed between the motor support and the driving motor to balance said device when said motor is suspended from a support structure.

21. A centrifugally rotating clothes drying hanger as claimed in claim 1, further comprising a protective cover extending downwardly from a center of said at least one rotational output device.

22. A centrifugally rotating clothes drying hanger as claimed in claim 1, wherein said protective cover has a cylindrical shape and includes outwardly extending separator fins arranged to separate said clothes from each other.

23. A centrifugally rotating clothes drying hanger as claimed in claim 1, wherein said motor support is integral with a casing comprising a bottom frame and support bars to which said driving motor is attached to provide an integral standalone structure.

24. A centrifugally rotating clothes drying hanger as claimed in claim 1, wherein said support structure includes a casing frame and said motor is attached to a bottom of said casing frame, said motor being in communication with said at least one rotational output device through a rod surrounded by a protective cover arranged to separate said rod and said clothes.

* * * * *